US006895679B2

(12) United States Patent
Dekort

(10) Patent No.: US 6,895,679 B2
(45) Date of Patent: May 24, 2005

(54) CHALK LINE WITH HANDLE RESERVOIR

(76) Inventor: Henry Dekort, 705 Chestermere Dr., Chestermere, Alberta (CA), T1X 1A5

( * ) Notice: Subject to any disclaimer, the term of this patent is extended or adjusted under 35 U.S.C. 154(b) by 0 days.

(21) Appl. No.: 10/445,872

(22) Filed: May 28, 2003

(65) Prior Publication Data

US 2003/0221325 A1 Dec. 4, 2003

Related U.S. Application Data

(60) Provisional application No. 60/384,399, filed on Jun. 3, 2002, and provisional application No. 60/397,018, filed on Jul. 22, 2002.

(51) Int. Cl.[7] ..... B44D 3/38
(52) U.S. Cl. ..... 33/414; 33/756; 33/767
(58) Field of Search ..... 33/413, 414, 755, 33/756, 760, 761, 767, 768, 769

(56) References Cited

U.S. PATENT DOCUMENTS

| | | | | | |
|---|---|---|---|---|---|
| 921,302 | A | * | 5/1909 | Starr | 33/414 |
| 3,126,637 | A | * | 3/1964 | Short | 33/414 |
| 3,206,855 | A | * | 9/1965 | Fletcher | 33/414 |
| 4,856,726 | A | * | 8/1989 | Kang | 33/767 |
| 5,212,875 | A | * | 5/1993 | Corso | 33/414 |
| 5,245,761 | A | * | 9/1993 | Waldherr | 33/767 |
| 5,440,820 | A | * | 8/1995 | Hwang | 33/761 |
| 5,444,919 | A | | 8/1995 | Alves | |
| 5,586,394 | A | | 12/1996 | Courtney | |
| 5,727,324 | A | * | 3/1998 | Moore | 33/414 |
| 5,822,874 | A | | 10/1998 | Nemes | |
| 6,079,112 | A | | 6/2000 | Love | |
| D435,469 | S | | 12/2000 | Jones | |
| 6,289,597 | B1 | | 9/2001 | Beyers | |
| 6,393,709 | B1 | * | 5/2002 | Jones | 33/414 |
| 6,434,843 | B1 | * | 8/2002 | Shor | 33/414 |
| 6,484,412 | B1 | * | 11/2002 | Donaldson et al. | 33/414 |

FOREIGN PATENT DOCUMENTS

| | | |
|---|---|---|
| FR | 2 679 950 | 2/1991 |

* cited by examiner

*Primary Examiner*—Diego Gutierrez
*Assistant Examiner*—Madeline Gonzalez
(74) *Attorney, Agent, or Firm*—Jean W. Goodwin; Linda M. Thompson

(57) ABSTRACT

A chalk line tool is provided having a tear-drop shaped body which houses a chalk line spool and chalk for coating the chalk line and a handle connected to the body and acting as a reservoir for additional chalk. The reservoir feeds the cavity in the body. The flow of chalk is controlled between the reservoir and the cavity. The handle advantageously acts to maintain the operator's hands away from the hand crank used to retract the chalk line and provides an extended reach with the tool for improved ergonomics when using the tool. The chalk line tool can be manufactured with the handle or can be retrofit with parts which are supplied as a kit.

15 Claims, 9 Drawing Sheets

CHALK LINE WITH HANDLE RESERVOIR

This application claims the benefit of Provisional Application No. 60/384,399, filed Jun. 3, 2002, and claims benefit Ser. No. 60/397,018, filed Jul. 22, 2002.

FIELD OF THE INVENTION

The invention relates to chalk lines and more particularly to retractable chalk lines having a housing, a spool rotatably mounted in the housing, and a chalk line wound on the spool.

BACKGROUND OF THE INVENTION

Chalk line reels are well known. Typically, a housing encloses a spool carrying a chalk line and also provides a space for powdered chalk which coats the chalk line for marking on surfaces when the line is snapped.

As shown in a number of U.S. patents, most notably U.S. Pat. No. 5,644,852 to Fuller et al., the entirety of which is incorporated herein by reference, the housing is typically a tear-drop shape which can be held in the hand. The housing does not provide a large reservoir for holding the chalk. Frequent refilling of the chalk reservoir results in lost man-hours as well as an increased nuisance value as it is often a messy operation. Further, the shape of the housing makes it difficult to hold while wearing gloves, particularly in the winter. Further, the shape positions the hand near the hand crank, during use, which may result in interference with freewheeling of the spool during deployment or retrieval of the chalk line. When not in use, the prior art typically teardrop-shaped tool is awkwardly stored in a tool belt pocket. Lack of any extended reach with the tool itself necessitates crouching at the surface to be marked in order to snap the chalk line on the surface to be marked. Further, it is difficult to position the tip of the handheld chalk line at the exact spot to be marked and to reach into corners and restricted locations. Poor ergonomics often result in lack of productivity at the worksite.

Attempts to increase the size of the housing, such as in U.S. Pat. No. 4,819,337 to Noyes, may result in an overly large tool, having a less desirable shape and which is more difficult to hold and actuate.

U.S. Pat. No. 6,079,112 to Love teaches a chalk line dispenser having a chalk reservoir threadably engaged with the reservoir in the housing. In this manner, commercial supplies of chalk can be threaded onto the housing or a chalk supply bottle can be used. While sufficient to provide an additional supply of chalk to the housing reservoir, the chalk supply bottle is not large enough to be functional as a handle, but instead adds to the tool's bulk, making it more awkward to handle and the nozzle is subject to blockage due to an overly large opening which can bridge.

Clearly there is a need for a retractable chalk line that has large chalk reservoir to prevent frequent filling, that has an extended reach to improve ergonomics, particularly for extending the vertical reach, reaching into corners and restricted spaces, is easy to store in a tool belt or pouch and that is easy to handle and carry.

SUMMARY OF THE INVENTION

A chalk line tool is provided having a body from which a handle extends, the handle acting as a reservoir for additional chalk to be stored. The reservoir is fluidly connected to the body of the tool to permit chalk to be supplied from the reservoir to the cavity. Additionally, the handle provides a convenient means by which to manipulate the tool while maintaining the hands away from the usual hand crank used to retract the chalk line after use. Further, the handle provides an extended reach with the tool, improving ergonomics, including when pressing the line against a surface and further, provides a convenient means by which the tool may be hung on a tool belt.

In one embodiment of the invention, the chalk line tool comprises a body, preferably tear-drop shaped, having a cavity defined therein and housing a spool around which a chalk line is retractably wound, chalk for coating the chalk line, and having a port at a first end through which the chalk line is extended and retracted. A handle extends from a second end of the tear-drop shaped body and has a reservoir defined therein, the reservoir acting to hold chalk and being fluidly connected to the cavity in the tear-drop shaped body. Preferably, the fluid connection between the reservoir and the cavity is restricted to prevent large amounts of chalk from bridging at the connection and possibly interfering with the motion of the spool.

More preferably, the chalk line tool further comprising brake means for restricting an amount of chalk line that can be released from the spool. The brake means further comprise a plurality of teeth formed about the spool; and a projection protruding inward through the body for engaging one of a plurality of spaces formed between the plurality of teeth formed about the spool. The projection is controlled through a trigger extending through an opening in the body.

In another embodiment of the invention, the chalk line tool is a retrofit to an existing tear-drop shaped chalk line tool which is conventionally without a handle. The base of the existing tool is replaced with a new base incorporating the handle. The new base comprises a body end portion and a handle end portion, the body end portion adapting to the existing body top, spool and a port through which the chalk line is extended and retracted. The handle may comprise a handle top portion and a handle base portion.

The base of the existing chalk line tool is removed and replaced by the base of the present invention, having the handle end portion. The existing top is reattached to the body end portion of the new base and the handle top portion is affixed to the handle end portion of the base. More preferably, a plate is provided for attachment between the new base's handle end portion and the handle top portion adjacent the second end of the body so as to seal between the handle and the body and to form a restricted channel between the reservoir and the cavity.

The elements of the retrofit chalk line tool are provided as a kit adapted for retrofitting existing chalk line tools so as to include the handle reservoir. The kit comprises the base, the handle top portion and preferably, a restrictor plate.

BRIEF DESCRIPTION OF THE DRAWINGS

FIG. 3*a* is a tool top viewed from within and FIG. 3*b* is a tool base viewed from within, the spool having been removed;

FIG. 7*a* is a handle top piece viewed from within, FIG. 7*b* is a tool base viewed from within and FIG. 7*c* is a channel plate viewed as it would lie on the tool base of FIG. 7*b;*

DETAILED DESCRIPTION OF THE PREFERRED EMBODIMENT

Figure 1A:
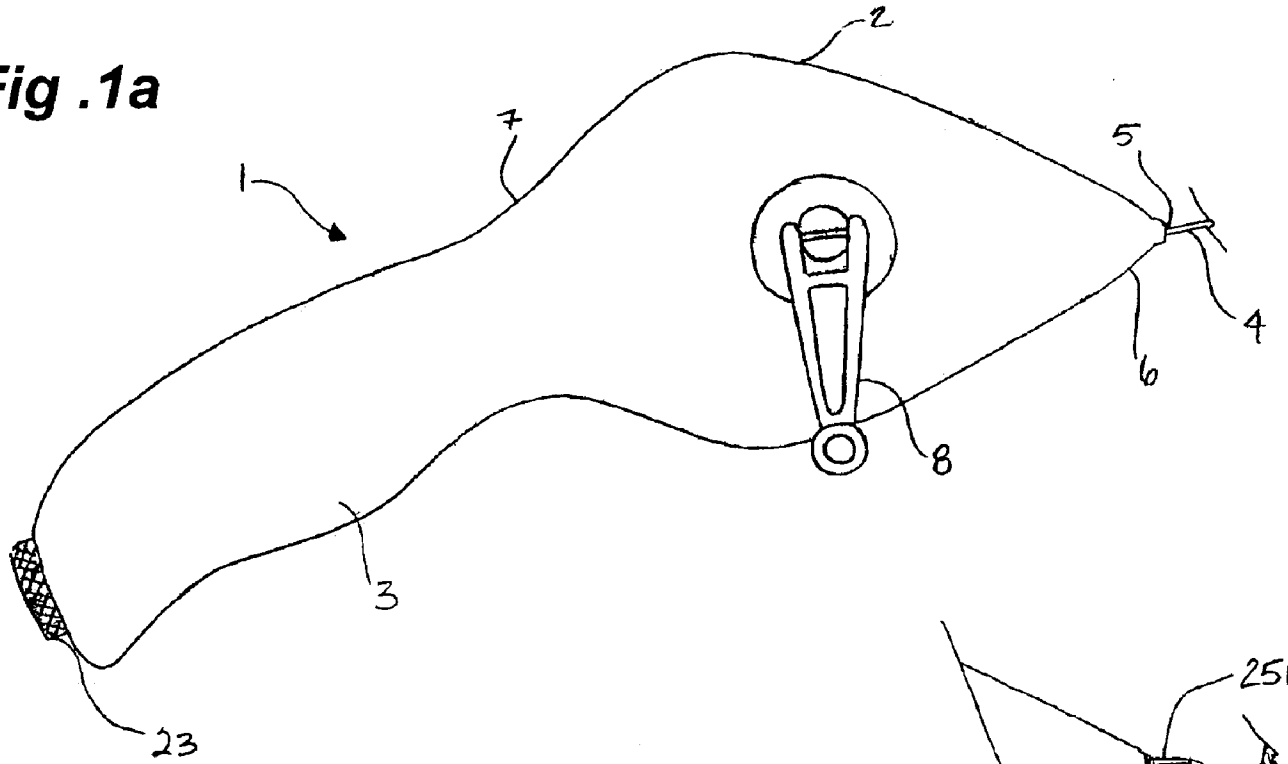
FIG. 1*a* is a front side view of a chalk line tool of a first embodiment of the present invention.
Figure 5:
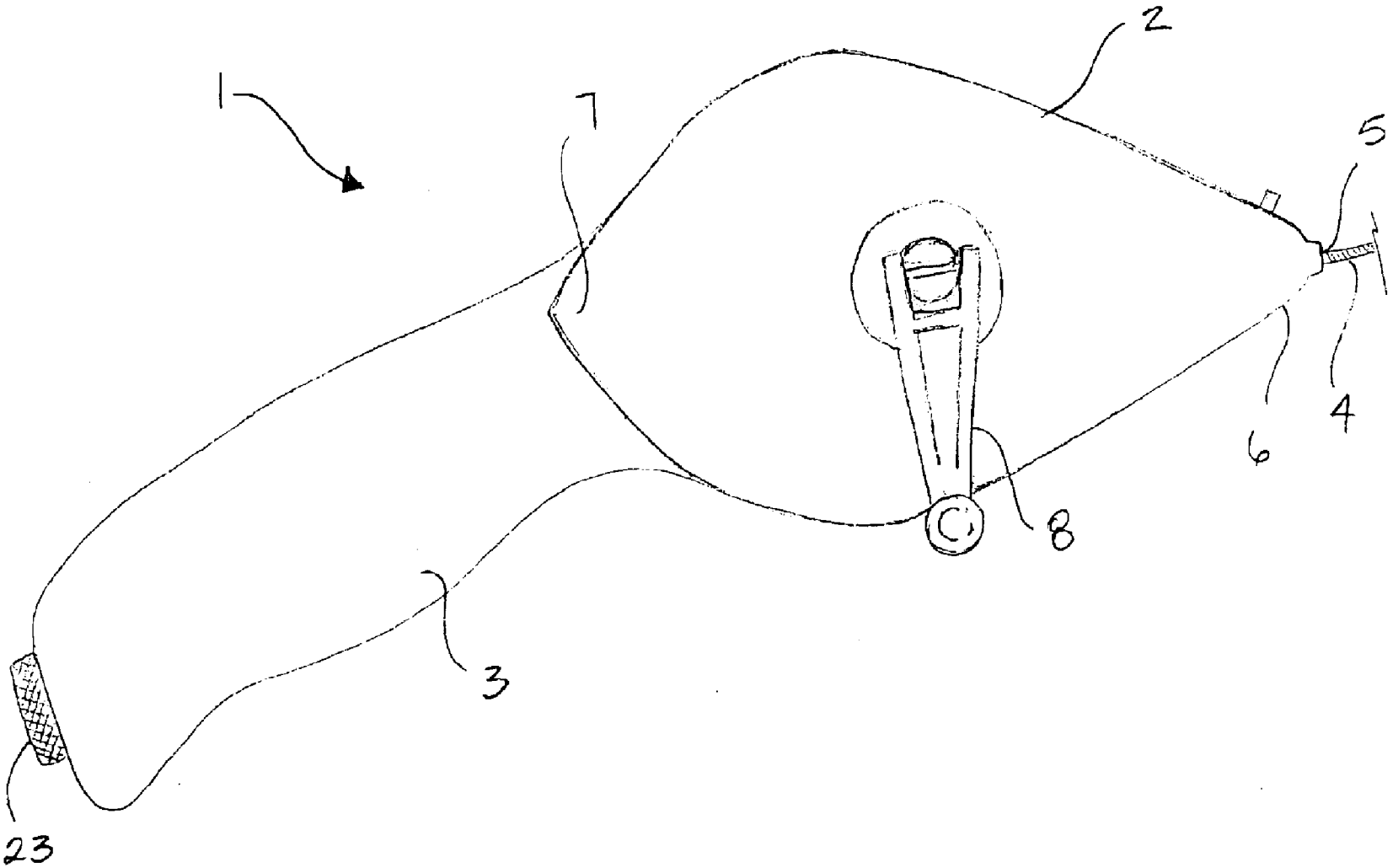
FIG. 5 is a front side view of another embodiment of the invention wherein the handle portion is a retrofit to an existing tear-drop shaped chalk line tool.

Having reference to FIGS. 1*a* and 5, a chalk line tool 1 of the present invention is shown. The chalk line tool 1 comprises a body 2 and a handle 3.

In preferred embodiments, the body 2 has a typical tear-drop shape, found in many prior art chalk lines. A chalk line 4 extends and is retractable through a small port 5 at a first end or apex 6 of the body 2. The handle 3, extends from a second or opposing end 7, about diametrically opposite from the port 5, the handle 3 providing the tool 1 with an extended reach.

Figure 3A:
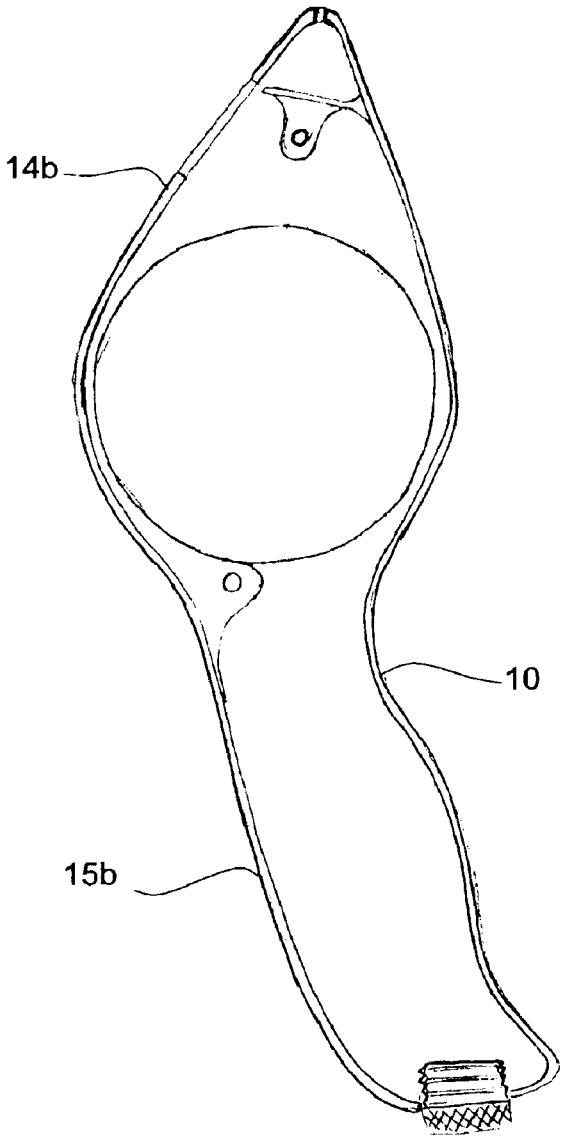
FIGS. 3*a* and 3*b* are plan views of the internals of a top and a base of a chalk line tool according to FIG. 1*a*. More particularly
Figure 3B:
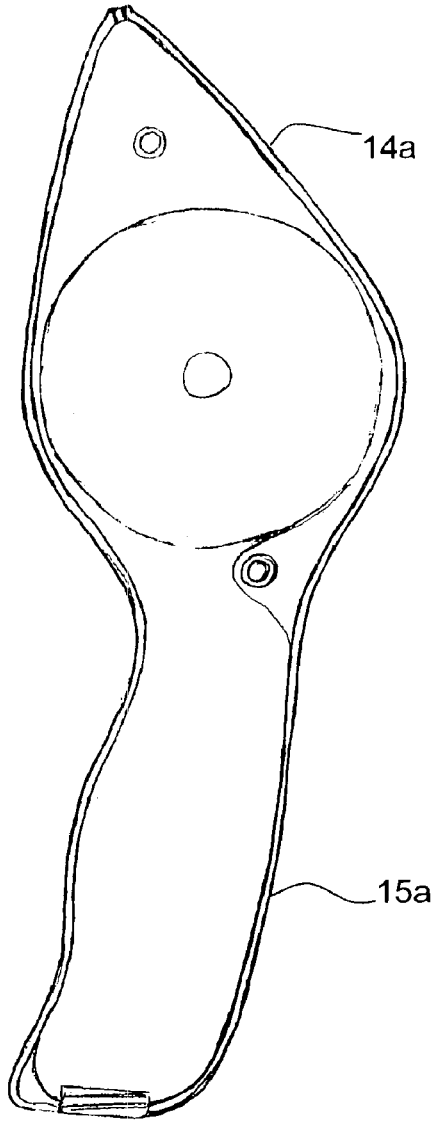
Figure 6:
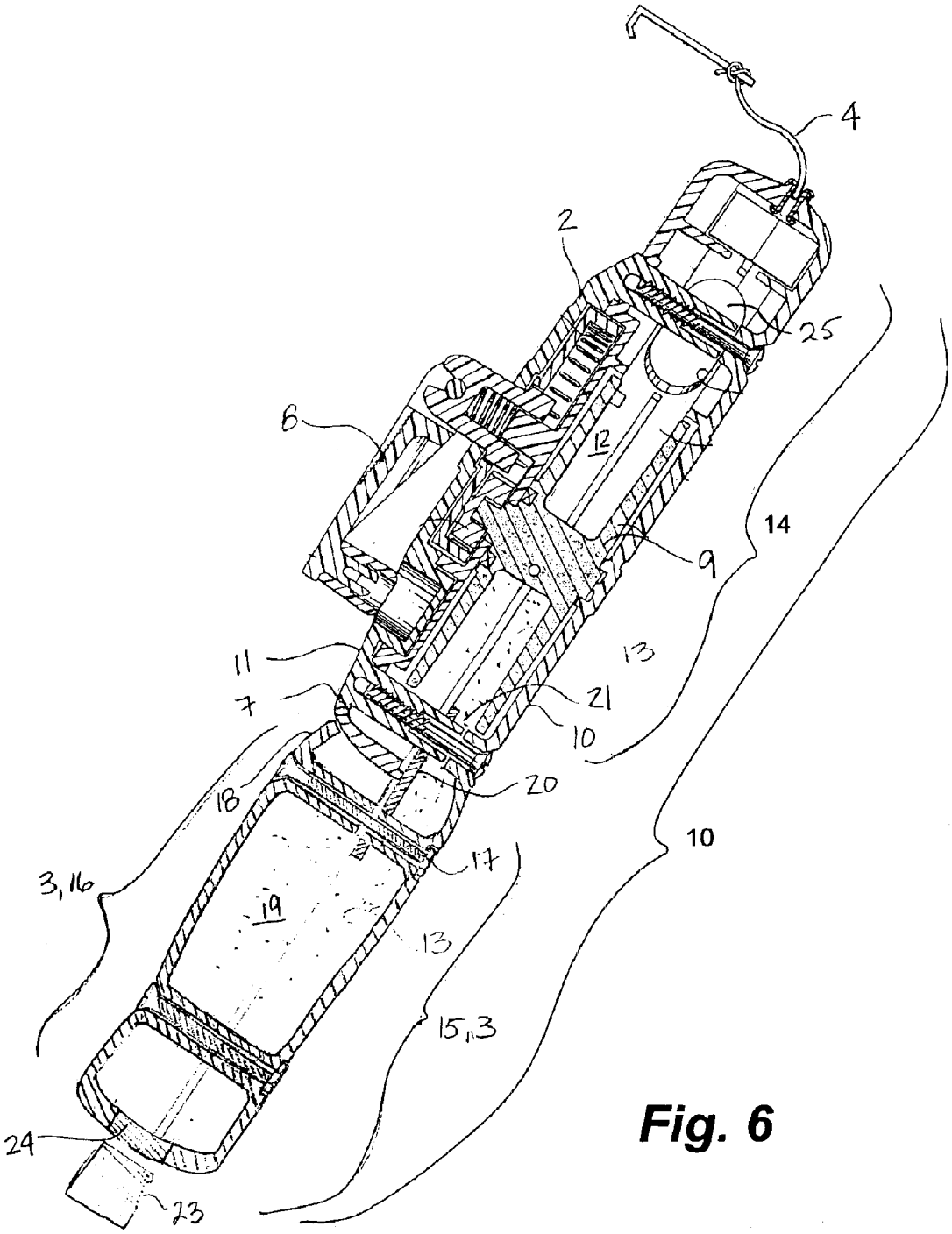
FIG. 6 is a cross-sectional view of the chalk line tool according to FIG. 4.

As shown in FIGS. 3 and 6, chalk line 4 is wound about a spool 9 housed in the body 2. A hand crank 8 is located on the body 2 and is connected to the spool 9 so as to permit retraction of the any chalk line 4 extended outside the body back into the tool's body 2.

In each embodiment the body 2 comprises a base 10 and a top 11 and defines a cavity 12 therebetween in which chalk 13 is stored for coating the chalk line 4.

The handle 3 is connected to the body 2. Various techniques are applied in a variety of embodiments disclosed herein for assembling the body 2 and the handle 3.

In a first embodiment of FIGS. 1*a*–4, both the base 10 and the top 11 are formed with complementaly body end portions 14*a*, 14*b* and complementary handle end portions 15*a*, 15*b*. In other words, as best seen in FIGS. 3*a* and 3*b*, the body 2 and handle 3 are unitary, having a common contiguous base 10. Further, the body 2 and handle 3 have a common contiguous top. The handle end portions 15*a*, 15*b* of the top 11 and the base 10, when fastened together, define a reservoir 19 for storing additional volumes of chalk 13. The body end portions 14*a*, 14*b* when fastened together form the cavity 12 housing the spool 9 and line 4.

The reservoir 19 is fluidly connected to the cavity 12 for supplying chalk 13 thereto. To control the amount of chalk 13 flowing therebetween, a channel between the reservoir 19 and the cavity 12 is preferably restricted. Restriction of the channel 20 can minimize bridging between the cavity 12 and the reservoir 19 and possibly avoid interference with the motion of the spool 9.

A threaded plug 23 is removeably secured in a port 24 formed in the handle 3, providing convenient access for filling the handle reservoir 19.

The handle 3 of the chalk line tool 1 can be oriented for improved comfort in either right handed or left handed use and have a shaped profile. As shown in FIGS. 1*a* and 5, the handle 3 is angled from the body 2 for improved ergonomics. Further, the addition of the handle positions the operator's hand away from the body 2 of the tool 1 and provides an extended reach, positioning the port 5 further away from an operator. The extension of the handle 3 and operator from the body 2 further minimizes interference with the conventional spinning of the hand crank 8 during extension and retraction of the chalk line 4.

Figure 8:
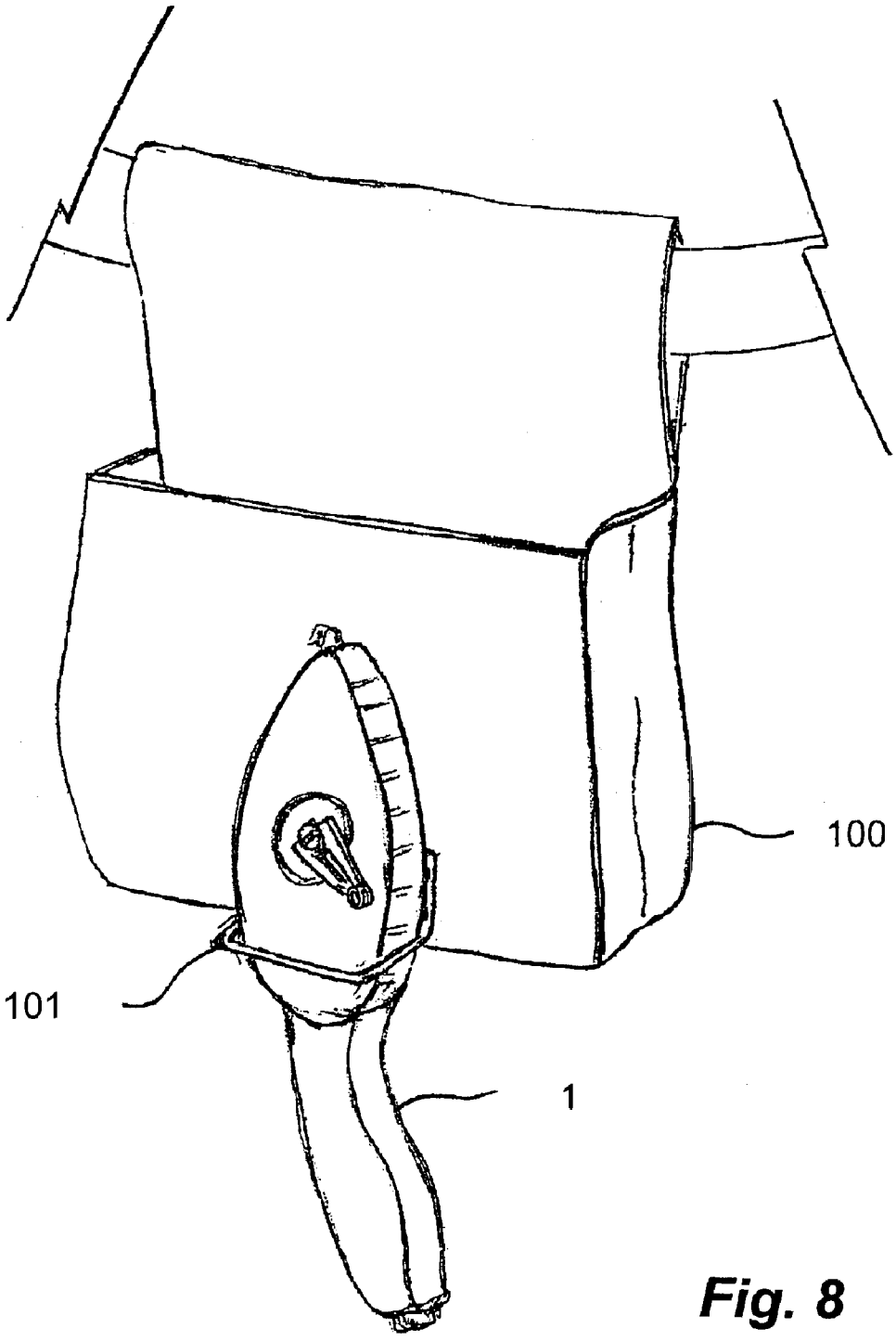
FIG. 8 is a partial perspective view of any embodiment of the chalk line tool stowed in a conventional tool belt.
Figure 9:
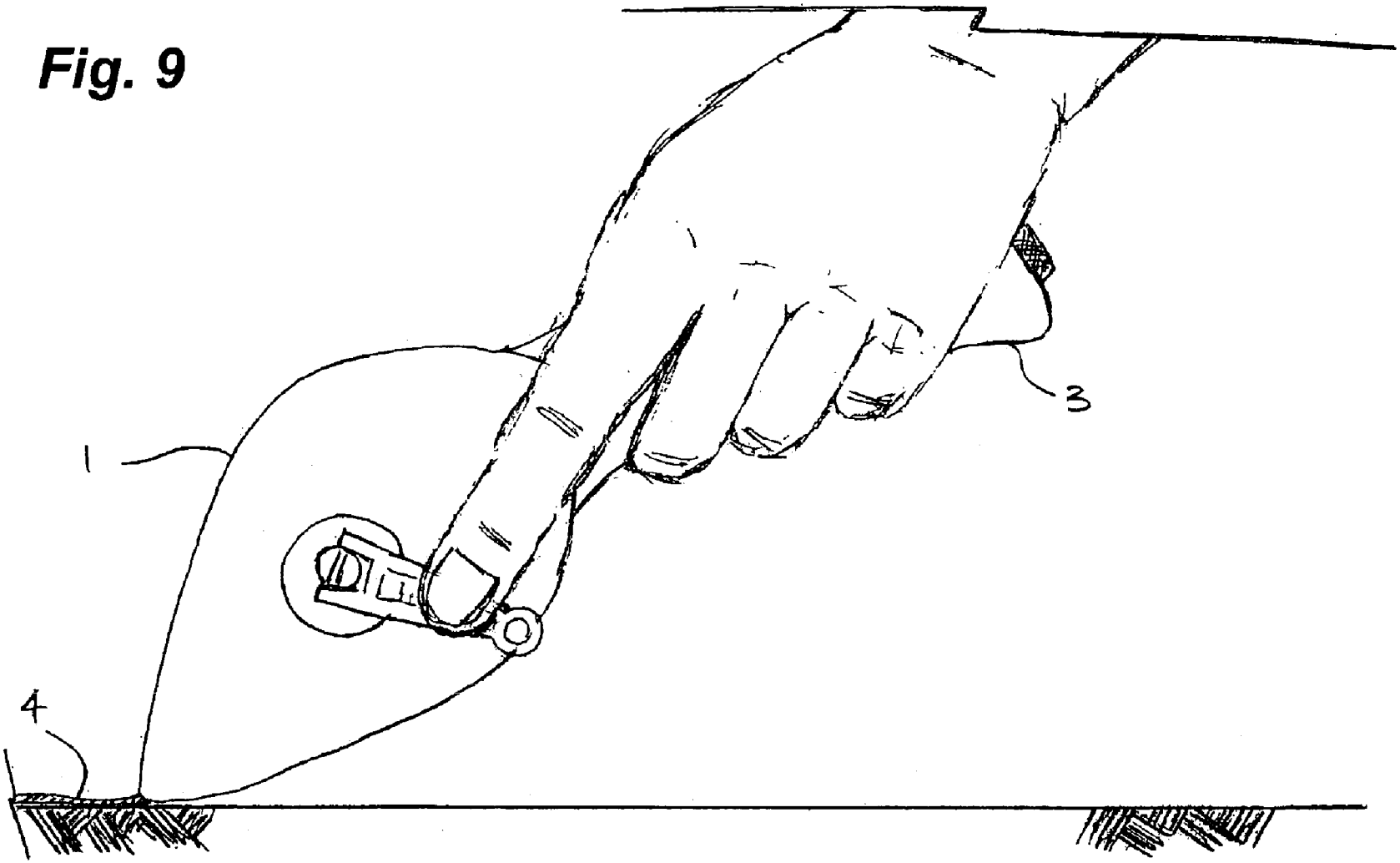
FIG. 9 is a partial perspective view of the chalk line tool, according to FIG. 1*a*, in use illustrating the extended reach of the tool.

As shown in FIG. 8, the handle also permits the tool 1 to be conveniently cradled in a tool belt 100 where the handle 3, much like the handle of a hammer, can engage loops 101 positioned on the tool belt 100 for that purpose. Preferably, the tool 1 is manufactured using injection molded ABS plastic.

In use, as shown in FIG. 8, the extended reach provided by the handle permits the operator to merely bend to snap the chalk line 4, rather than crouch at the surface to be marked, thereby improving the ergonomics of the tool 1. Conveniently, a chalk line tool 1 having a hand crank 8 can be easily restrained in use.

Figure 4:
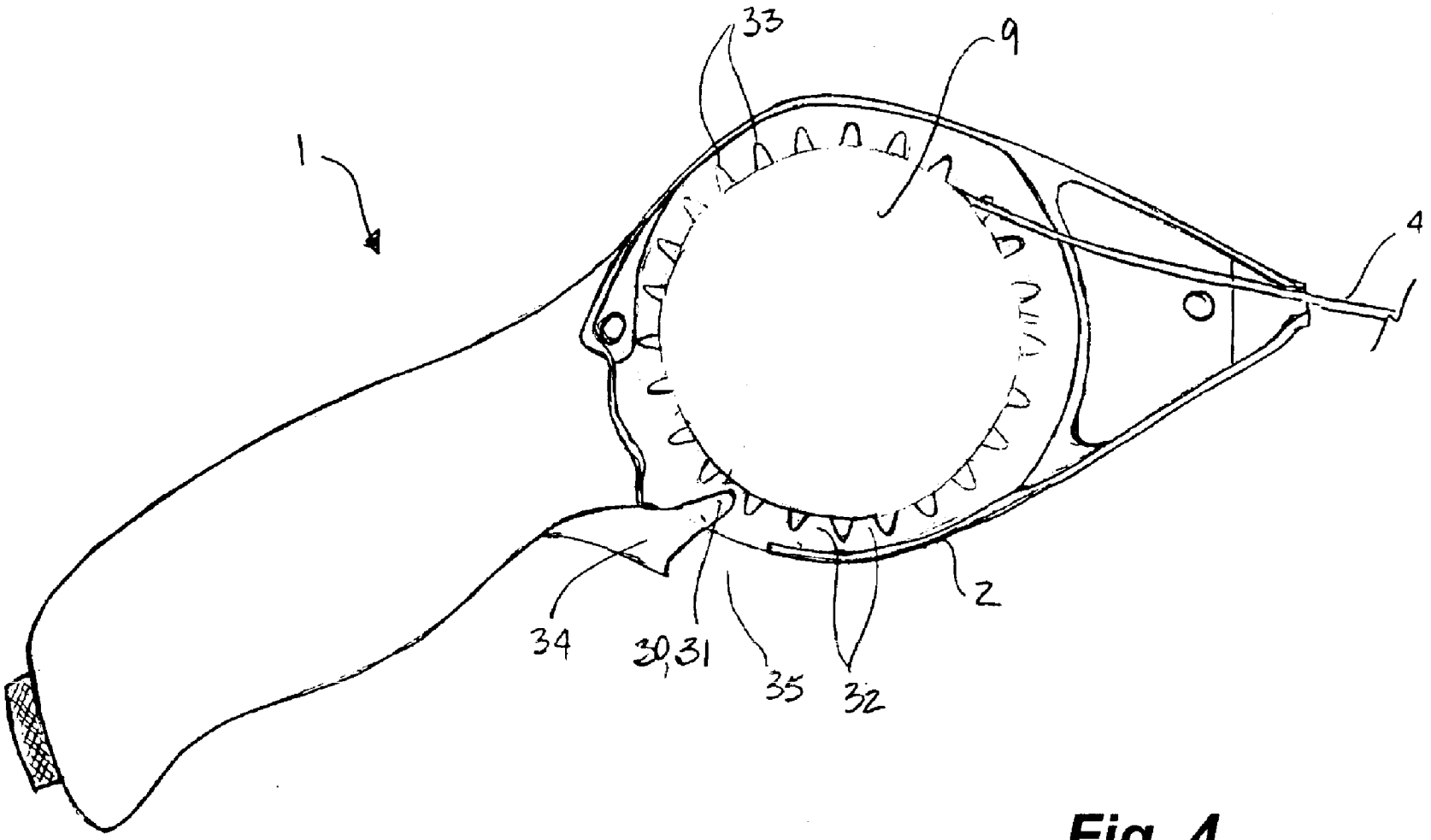
FIG. 4 is a partially cutaway top view of the chalk line tool showing an optional brake means.

With reference to FIG. 4, in another embodiment, a brake 30 is provided to restrict the motion of the spool upon operator control. For example, the brake can restrict an amount of chalk line 4 that can be released from the spool 9 and to maintain a length of chalk line 4 at the desired length until after the chalk line has been snapped. Preferably, the brake 30 comprises means such as a pad, a spring, a member or other means for engaging the spool 9. Preferably the means is a projection 31 protruding inwards through the body 2 of the chalk line tool 1 to alternately engage the spool. More preferably, the projection 31 engages a space 32 between a plurality of teeth 33 formed about the spool 9. The projection 31 is attached to a trigger 34 extending through an opening 35 in the body 2. The trigger is spring biased (not shown) so as to normally project sealably into the cavity 12 of the body portion 2 to engage the teeth 33 on the spool 9. In operation, the trigger is actuated to release the projection 31 from the teeth 33 in the spool 9, allowing the spool 9 to freewheel. While maintaining actuation of the trigger 34, chalk line 4 is pulled from the spool 9 until a desired amount has been released. The trigger 34 is then released and the projection 31 again engages the spool 9 between the next available space 32 between the teeth 33 on the spool 9, restricting the motion of the spool 9 and preventing additional release of the chalk line 4 from the spool 9. Once a line has been marked by snapping the chalk line 4, the trigger 34 is again actuated and the chalk line 4 is reeled back onto the spool 9 using the hand crank 8.

In another embodiment of the invention, as shown in FIGS. 4–7*c*, an existing chalk line tool can be retrofit through the addition of the handle 3. An existing chalk line tool 1 having a typically tear-drop shaped body 2 comprises an existing conventional body base (removed—not shown) and a body top 11 which defines the cavity 12 in which the spool 9 and chalk 13 is stored. The existing conventional base replaced by a base 10 of the present invention having a body end portion 14 and a base handle end portion 15. The base 10 is adapted to be compatible with the existing tool 1 as necessary to ensure operation of the existing spool 9 and line 5. The existing body top 11, spool 9 and line 5 are secured to the body end portion 14.

Preferably the handle end portion 15 comprises a handle top portion fastened to the base end portion 15, typically using fasteners, such as screws or nut and bolt fasteners. A first end 18 of the handle top portion 16 abuts the body 2 at an apex 7 of the tear-drop shaped body 2. The base 10 extends the length of the base handle end portion 15 and body end portion 14. The handle top portion 16 when fastened together with the base handle end portion 15, defines the handle reservoir 19.

Figures 7A, 7B, 7C:
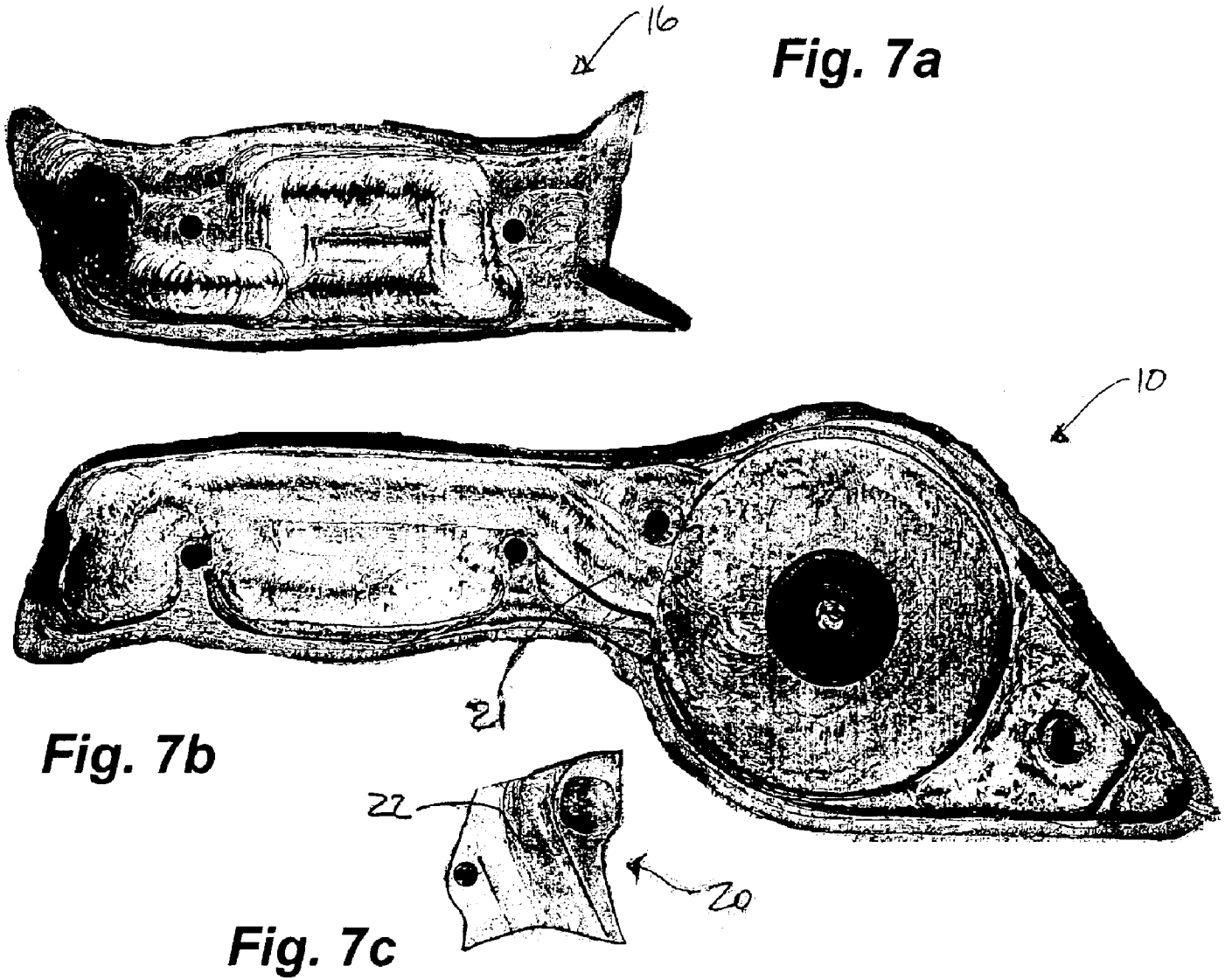
FIGS. 7*a*, 7*b* and 7*c* are plan views of the internals of a set of parts provided in a kit for retrofitting a tear-drop shaped chalk line tool according to FIG. 5. More particularly

As shown in FIGS. 7*a*–7*c*, to control the flow of chalk 4 between the cavity 12 and the reservoir 19, a channel restrictor plate 22 is positioned between the base handle end portion 15 and the handle top portion 16 adjacent the apex 7 of the body 2 forming the restricted channel 21 between the reservoir 19 and the cavity 12. The channel restrictor plate 20 further incorporates a groove or seal 22 for sealing against a periphery of the body top 11. Some existing chalk line tools have an apex 7 which is suitably shaped for sealing directly to the first end 18 of the handle 3 and therefore do not require the use of a plate or seal 22. Again, a threaded plug 23 is removeably secured in a port 24 formed in the assembled handle 3.

As before for the first embodiment, the handle 8 of the chalk line tool 1 provides the advantages of ergonomics, extension and minimizes interference during extension of the chalk line.

The chalk line tool 1 of the embodiment of FIGS. 4–7*c* can be provided as a retrofit handle to fit an existing chalk line. In FIGS. 7*a*–7*c*, the base 10, the handle top portion 16 and the channel restrictor plate 20 are provided as separate parts for adapting to the spool 9 and body top 11 of an existing chalk line tool 1, after removal of the conventional base.

In the retrofit embodiment, the channel plate 20 further aids in preventing chalk 4 from escaping at a junction between the handle top portion 16 and the base handle end portion 15.

A usual slide opening 25 of the existing chalk line tool 1 can be used as an additional port for filling the cavity 12 with chalk or can be permanently blocked by an integrated projection from the base 10 to replace the separate slider and thus seal the conventional chalk re-fill opening.

Figure 1B:
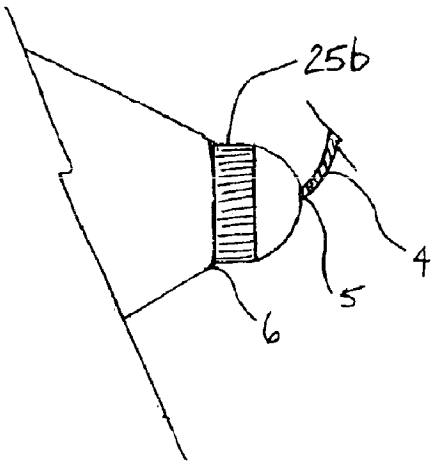
FIG. 1*b* is a cutaway view of an alternate chalk line tool according to FIG. 1*a;*
Figure 2:
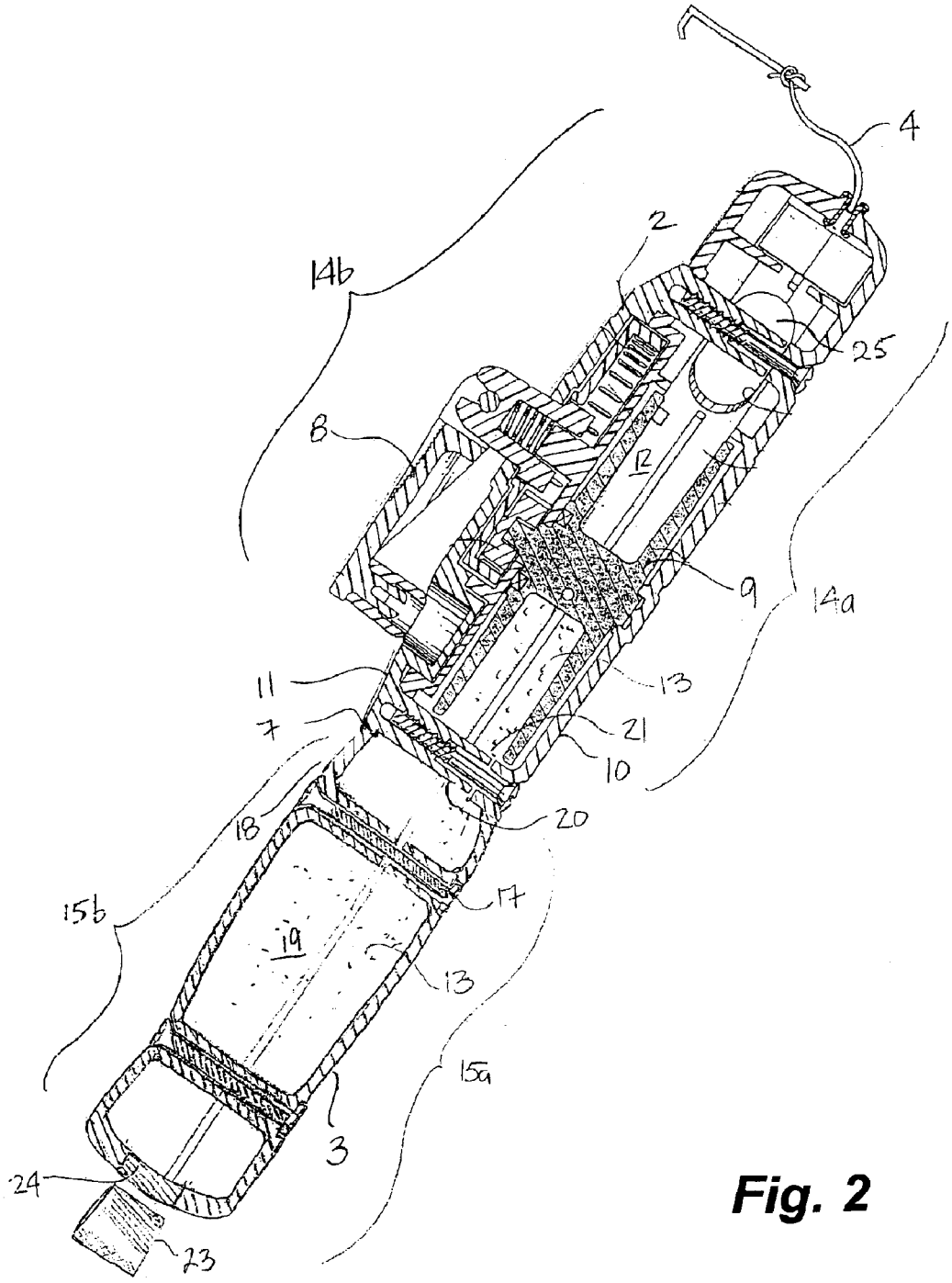
FIG. 2 is a cross-sectional view of the chalk line tool according to FIG. 1*a;*

Alternatively, as shown in FIG. 1*b*, the existing chalk line 1 may be provided with a screw cap opening 25*b* at the first end 6, through which the chalk line port 5 is also formed. The screw cap opening 25*b* can also be used as an additional port for filling the cavity 12 with chalk.

What is claimed is:

1. A chalk line tool comprising:

a unitary base having a handle base and a body base;

a body top for fastening to the body base for forming a body having a cavity therebetween for housing a spool around which a chalk line is extensibly and retractably wound, the body adapted for containing chalk for coating the chalk line and having a port at a first end through which the chalk line is extended and retracted;

a handle top for fastening to the handle base for forming a handle defining a chalk reservoir therebetween; and a channel between the cavity and the reservoir separating the cavity from the reservoir, the reservoir being fluidly connected to the cavity, wherein the body top and the handle top are unitary.

2. The chalk line tool as described in claim 1 wherein the handle further comprises:

a port for the addition of chalk thereto; and a plug for removembly sealing the port.

3. The chalk line tool as described in claim 1 further comprising a brake for actuating freewheeling of the spool for controlling release of chalk line from the spool.

4. The chalk line tool as described in claim 3 wherein the brake further comprises:

a plurality of teeth formed about the spool; and a projection protruding inward through the body for alternately engaging one of a plurality of spaces formed between the plurality of teeth formed about the spool.

5. The chalk line tool as described in claim 4 wherein the projection is attached to a trigger extending through an opening in the body, the trigger being biased to normally project into engagement with the one of a plurality of spaces; wherein when the trigger is actuated the projection is released from the one of a plurality of spaces permitting the spool to freewheel.

6. A chalk line tool comprising:

a unitary base having a handle base and a body base;

a body top for fastening to the body base for forming a body having a cavity therebetween for housing a spool around which a chalk line is extensibly and retractably wound, the body adapted for containing chalk for coating the chalk line and having a port at a first end through which the chalk line is extended and retracted;

a handle top for fastening to the handle base for forming a handle defining a chalk reservoir therebetween, the reservoir being fluidly connected to the cavity; and a plate positioned between the handle base and the handle top for restricting the flow of chalk between the reservoir and the cavity, wherein the handle top is separate from the body top and when the handle top is fastened to the handle base the reservoir is formed therebetween, the reservoir capable of holding a supply of chalk therein and being fluidly connected to the cavity for supplying chalk thereto.

7. The chalk line tool as described in claim 6 wherein the handle further comprises:

a port for the addition of chalk thereto; and a plug for removeably sealing the port.

8. The chalk line tool as described in claim 6 further comprising a brake for actuating freewheeling of the spool for controlling release of chalk line from the spool.

9. The chalk line tool as described in claim 8 wherein the brake further comprises:

a plurality of teeth formed about the spool; and a projection protruding inward through the body for alternately engaging one of a plurality of spaces formed between the plurality of teeth formed about the spool.

10. The chalk line tool as described in claim 9 wherein the projection is attached to a trigger extending through an opening in the body, the trigger being biased to normally project into engagement with the one of a plurality of spaces; wherein when the trigger is actuated the projection is released from the one of a plurality of spaces permitting the spool to freewheel.

11. A kit adapted for use with an existing chalk line tool, the existing tool having a body having a body base and a body top for defining an existing shape and a cavity therebetween adapted for containing chalk, the body base being separable from the body top, the body top housing a spool around which a chalk line is retractably wound and having a port at a first end through which the chalk line is extended and retracted, the kit comprising:

a unitary base having a body end portion having a compatible shape adapted to the existing shape of the body top of the existing chalk line tool, and having a handle end portion which extends beyond the compatible shape for manipulation of the body end portion with an extended reach, wherein after separation and removal of the existing body base from the existing tool, the body end portion forms the body base and is adapted for fastening with the body top of the existing tool; and a handle top portion discrete from the body top of the existing tool and for forming a reservoir between the handle end portion and the handle top portion, the reservoir holding a supply of chalk therein and being fluidly connected to the cavity for supplying chalk thereto.

12. The chalk line tool as described in claim 11 further comprising brake means for actuating freewheeling of the spool for controlling release of chalk line from the spool.

13. The chalk line tool as described in claim 11 further comprising a plate for positioning between the handle top portion and the body top for sealing between the base, the handle top portion and the body top.

14. The chalk line tool as described in claim 13 wherein the plate restricts the flow of chalk between the reservoir and the cavity.

15. The chalk line tool as described in claim 11 wherein the handle top portion is separable from the handle end portion and is fastenable thereto.

* * * * *

UNITED STATES PATENT AND TRADEMARK OFFICE

Certificate

Patent No. 6,895,679 B2

Patented: May 24, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Henry Dekort, Chestermere, Alberta (CA); and Rick Gellete, Calgary, Alberta (CA).

Signed and Sealed this Twenty-Second Day of July 2008.

DIEGO F.F. GUTIERREZ
*Supervisory Patent Examiner*
Art Unit 2859